US007137324B2

(12) United States Patent
Ludwig et al.

(10) Patent No.: US 7,137,324 B2
(45) Date of Patent: Nov. 21, 2006

(54) HAND-HELD POWER SCREWDRIVER WITH A LOW-NOISE TORQUE CLUTCH

(75) Inventors: Manfred Ludwig, Landsberg (DE); Reinhard Riedl, Finning (DE)

(73) Assignee: Hilti Aktiengesellschaft, Schaan (LI)

( * ) Notice: Subject to any disclaimer, the term of this patent is extended or adjusted under 35 U.S.C. 154(b) by 156 days.

(21) Appl. No.: 11/006,310

(22) Filed: Dec. 7, 2004

(65) Prior Publication Data

US 2005/0126802 A1 Jun. 16, 2005

(30) Foreign Application Priority Data

Dec. 15, 2003 (DE) ..... 103 58 570

(51) Int. Cl.
*B25B 23/157* (2006.01)
*B25B 7/02* (2006.01)

(52) U.S. Cl. ..... 81/475; 81/473; 81/429

(58) Field of Classification Search ..... 81/475, 81/473, 429, 467, 474; 173/15, 176
See application file for complete search history.

(56) References Cited

U.S. PATENT DOCUMENTS 4,650,007 A * 3/1987 Fujita et al. ..... 173/178
4,842,078 A * 6/1989 Hansson ..... 173/178
5,538,089 A * 7/1996 Sanford ..... 173/2
5,775,186 A * 7/1998 Rahm ..... 81/474
6,739,225 B1 * 5/2004 Bader et al. ..... 81/475
6,851,343 B1 * 2/2005 Sasaki ..... 81/475
6,892,611 B1 * 5/2005 Sasaki ..... 81/467
2003/0110910 A1 * 6/2003 Bader et al. ..... 81/475

* cited by examiner

*Primary Examiner*—Lee D. Wilson
*Assistant Examiner*—Alvin J. Grant
(74) *Attorney, Agent, or Firm*—Abelman, Frayne & Schwab

(57) ABSTRACT

A hand-held power screwdriver includes a low-noise torque clutch (5) for transmitting torque to a tool spindle (4) and formed of claw clutch (6) and ratchet clutch (7), with the ratchet clutch (7) having a rotatably driven first ratchet member (7*a*) and a second ratchet member (7*b*) both having, respectively, oppositely oriented, circumferentially arranged, oblique cams (9), with the claw clutch (6) having a first claw member (6*a*) and a second claw member (6*b*) having oppositely oriented claws (11), respectively, the first claw member (6*a*) of the claw clutch (6) being fixedly connected with the second ratchet member (7*b*) of the ratchet clutch (7) for joint rotation therewith, and with the screwdriver further including at least one engagement member (12) for connecting the second claw member (6*b*) with the tool spindle (4) for joint rotation therewith and for disconnecting the claw member (6*b*) from the tool spindle (4) and a retaining element for connecting the second claw member (6*b*) of the claw clutch (6) with the tool spindle (4) in a free-running position.

9 Claims, 2 Drawing Sheets

HAND-HELD POWER SCREWDRIVER WITH A LOW-NOISE TORQUE CLUTCH

BACKGROUND OF THE INVENTION

1. Field of Invention

The present invention relates to a hand-held power screwdriver with a low-noise torque clutch.

2. Description of the Prior Art

In the hand-held power screwdrivers used for screwing in of screws, in order to prevent overrotation of a screw, force flow from the drive motor to the screw-driving tool is interrupted upon the torque reaching a predetermined threshold. A conventional torque clutch has two rachet clutches preloaded against each other. The ratchet members have respective, circumferentially arranged, oblique cams. The drawback of a conventional ratchet clutch is a disturbing loud grating which in addition to noise, which leads to a significant wear of the ratchet clutch.

European Patent EP990488B1 discloses a hand-held power screwdriver with a low-noise torque clutch which is formed as a combination of a ratchet clutches. To this end, oblique cams are formed on opposite sides of an axially displaceable ratchet member and are associated with two axially spaced ratchet clutches. The combination torque clutch is unnecessarily very complex and, with two ratchet clutches, the wear of the power screwdriver is unnecessarily high.

Accordingly, an object of the present invention is to provide a hand-held power screwdriver with a low-noise torque clutch having a low wear.

SUMMARY OF THE INVENTION

This and other objects of the present invention, which will become apparent hereinafter, are achieved by providing a hand-held power screwdriver having a support sleeve, a tool spindle axially displaceable in the support sleeve, a spindle spring for axially resiliently preloading the tool spindle and a low-noise torque clutch for transmitting torque to the tool spindle. The torque clutch is formed of combined claw clutch and ratchet clutch. The ratchet clutch has a ratchet clutch spring for axially resiliently preloading the ratchet clutch, a rotatably driven first ratchet member and a second ratchet member both having, respectively, oppositely oriented, circumferentially arranged oblique cams. The claw clutch has a claw clutch spring for axially resiliently preloading the claw clutch, a first claw member and a second claw member both having, respectively, oppositely oriented claws. The first claw member of the claw clutch is fixedly connected with the second ratchet member of the ratchet clutch for joint rotation therewith. The second claw member is connected with the tool spindle by at least one engagement member for joint rotation with the tool spindle and for being disconnected from the tool spindle. A retaining element secures the second claw member of the claw clutch to the tool spindle in the free-running position of the screwdriver.

The provision of an engagement member for connecting the second claw member with the tool spindle for joint rotation therewith, and of retaining element for securing the second claw member with the tool spindle in the free-running position permitted to provide a technologically simple, low-noise torque clutch. Because only one ratchet clutch is used, the wear of the torque clutch is noticeably reduced.

Advantageously, the spring rigidity of the ratchet clutch spring is greater than a spring rigidity of the spindle spring, a spring rigidity of which is greater than a spring rigidity of the claw clutch spring. As a result, upon axial rearward displacement of the tool spindle in the screwdriver over a set switching path, first the claw spring, then the spindle spring, and finally the ratchet spring become compressed and vice versa.

Advantageously, the second ratchet member and the claw member are formed by a ratchet sleeve freely rotatable about the tool spindle and axially displaceable therealong, with a rear end side of the ratchet sleeve forming the circumferentially arranged, oblique cams and with a front, drive end side forming the straight claws. Thereby, a technologically simple combination of a ratchet clutch with a claw clutch is achieved.

Advantageously, the second claw member is formed by a rear end side of a claw sleeve axially displaceable over the tool spindle, with the at least one engagement member connecting the claw sleeve with the tool spindle for joint rotation therewith. Thereby, a technologically simple switching of the claw clutch by an axial displacement of the claw sleeve is achieved.

Advantageously, the claw sleeve has, at its rear side, at least one, extending radially inwardly, entrain web cooperating with the at least one engagement member and has, at its front, drive side, a free-running region formed as an annular inner groove. Thereby, upon an axial displacement of the claw sleeve, it becomes formlockingly connected with the engagement member.

Advantageously, the retaining element is formed as an annular O-ring securable on the tool spindle and becoming pinched between the tool spindle and the claw sleeve in the free-running position, frictionally securing the claw sleeve against the resiliently preloaded claw spring. Thereby, a technologically simple retention of the claw sleeve against the biasing force of the claw spring is achieved.

Advantageously, the engagement member is formed as a cylinder oriented parallel to the tool spindle and arranged radially inside and outside of tool spindle, with a cylinder axis coinciding with a circumferential surface of the tool spindle. Such an engagement member is capable of transmitting high torques.

Advantageously, there are provided several engagement members, preferably, three engagement members. With several, in particular with three engagement members, the tool spindle is not subjected to bending torques and is capable of transmitting high torques.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
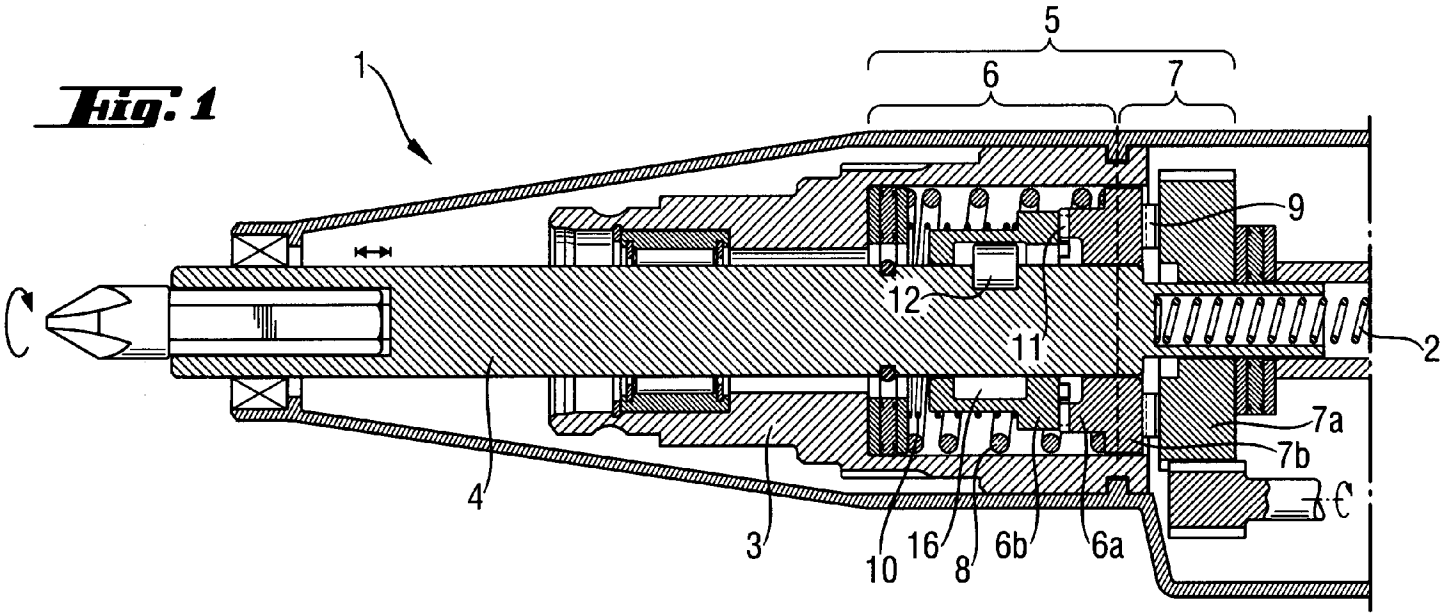
FIG. 1 a longitudinal cross-sectional partial view of a hand-held power screwdriver according to the present invention.

A hand-held power screwdriver according to the present invention, a portion of which is shown in FIG. 1, includes a rotatably driven, working tool spindle 4 axially displaceable in a support sleeve 3, a semi-rigid spring 2 for axially preloading the tool spindle 4, and a low-noise torque clutch 5 for transmitting torque to the tool spindle 4. The torque clutch 5 is formed of a claw clutch 6 and a ratchet clutch 7. The ratchet clutch 7, which is axially resiliently preloaded with a rigid spring 8, has a first ratchet member 7*a* rotatably driven by an electric motor (not shown), and a second ratchet member 7*b*. The first and second ratchet members 7*a* and 7*b* are provided, respectively with oppositely oriented, circumferentially arranged, oblique cams 9. The claw clutch 6, which is axially resiliently preloaded with a weak spring 10, has a first clutch member 6, which is connected with the second ratchet member 7*b* of the ratchet clutch 7 for joint rotation therewith, and a second claw member 6*b*. The claw members 6*a* and 6*b* are provided, respectively, with oppositely oriented, circumferentially arranged, straight claws 11. As it is graphically illustrated by the thickness of the spring wire, the springing rigidity of the ratchet clutch spring 8, which is formed as a compression spiral spring, is greater than the rigidity of the tool spindle spring 2 the rigidity of which is, however, greater than the rigidity of the claw spring 10. In the completely unloaded idle position, which is shown in the drawing, the ratchet clutch 7 is clutched by the biasing force of the spring 8, the tool spindle 4 is located in its completely driven position as a result of application thereto of the biasing force of the spring 2, and the claw clutch is clutched by the biasing force of the claw spring 10. An engagement member 12, which is secured on the tool spindle 4, is located in a circumferentially free idle region 16 of the second claw member 6*b*, which is formed as an inner annular groove, whereby the tool spindle 4 is freely rotatable, without an application of a load thereto.

Figure 2:
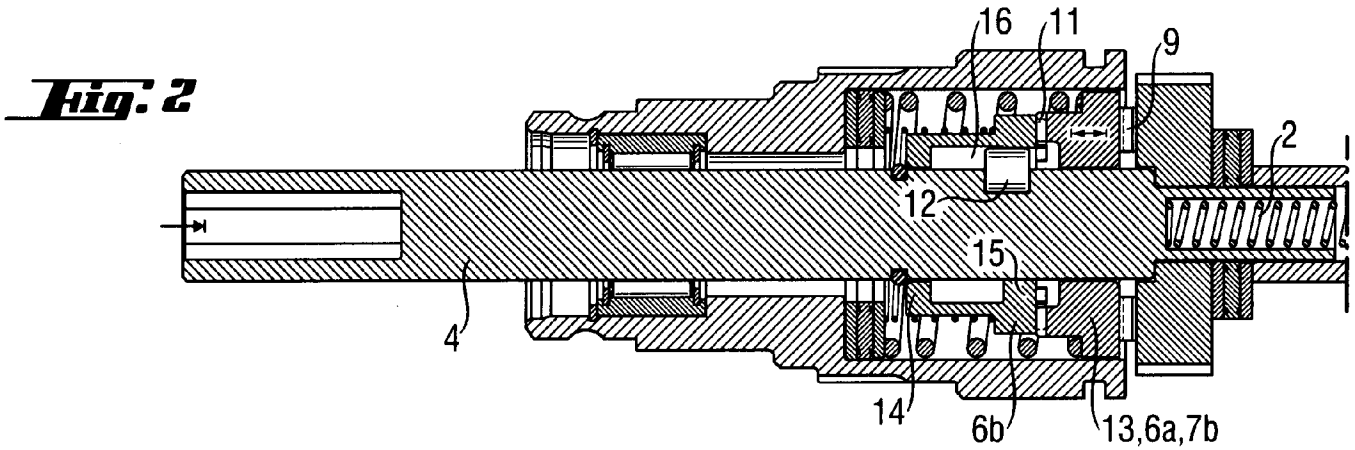
FIG. 2 a cross-sectional view of a detail of the power screw-driver shown in FIG. 1 in its screwdriving position.

In the screwdriving position of the power screwdriver according to the present invention, which is shown in FIG. 2, with the tool spindle 4 being axially offset, at its rear side, against the biasing force of the semi-rigid spring 2, the engagement member 12, which is axially displaced together with the tool spindle 4, connects the second claw member 6*b* of the claw clutch 6 with the tool spindle 4 for joint rotation therewith. The second ratchet member 7*b* is provided, together with the first claw member 6*a*, on a ratchet sleeve 13. The ratchet sleeve 13 is mounted on the tool spindle 4 for rotation thereabout and for axial displacement relative thereto. The circumferentially arranged, oblique cams 9 are provided on the rear end side of the ratchet sleeve 13, and the straight claws 11 are provided on the front or drive end side of the ratchet sleeve 13. The second claw member 7*b* is formed on the rear end side of the claw sleeve 14, which is axially displaceable on the tool spindle 4 but which is connected with the tool spindle 4 for joint rotation therewith by the engagement member 12 in the screwdriving position shown in FIG. 2. To this end, the claw sleeve 14 has, at its rear side, an extending radially inward entrain web 15 that cooperates with the engagement member 12, with the idle region 16 being formed at the drive side of the claw clutch sleeve 14.

Figure 3:
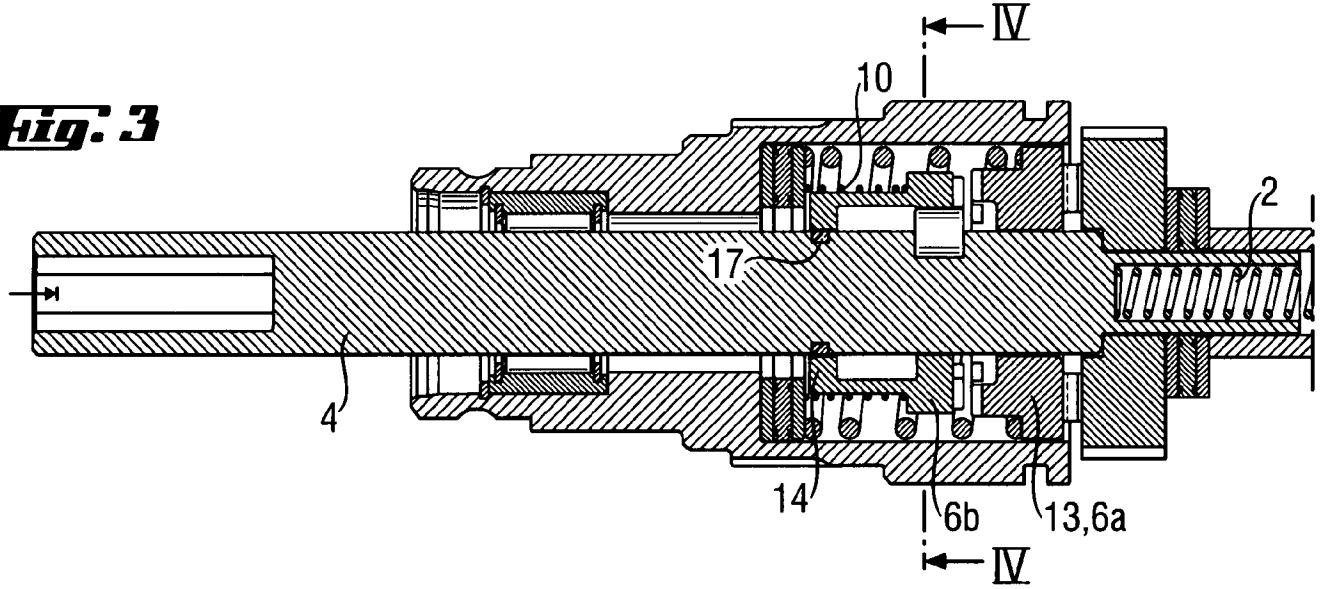
FIG. 3 a cross-sectional view of the detail shown in FIG. 2 in a free-running position of the power screwdriver.

In the free-running position of the power screwdriver according to the present invention, which is shown in FIG. 3, the first claw member 6*a* and the second claw member 6*b* are spaced from each other and are, thus, disconnected. A retaining member 17 is formed as an annular O-ring which is secured on the tool spindle 4. The retaining member 17 is displaced into the free-running position from the screwdriving position, which is shown in FIG. 2, upon a torque exceeding a predetermined threshold, as a result of disengagement of the ratchet sleeve 13 which is caused by rotation in opposite directions of the cams 9, and thereby of the claw sleeve 14. The retaining member 17 becomes coaxially deformed between the tool spindle 4 and the claw sleeve 14 and the claw sleeve 14 become frictionally secured in the free-running position against the biasing force of the weak preloaded claw spring 10 until the tool spindle 4 is axially released. The semi-rigid spindle spring 2 biases the tool spindle 4 in the screwdriving direction, whereby the claw sleeve 14 disengages from the retaining member 17, the O-ring, and occupies the idle position shown in FIG. 1.

Figure 4:
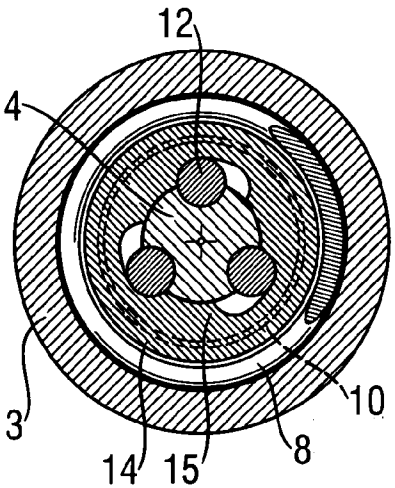
FIG. 4 a cross-sectional view along line IV—IV in FIG. 3.

Generally, as shown in FIG. 4, there are provided three engagement members 12 which are formed as cylinders and are oriented parallel to the tool spindle 4. The engagement cylinders are arranged radially inside and outside of the tool spindle 4, with respective axes coinciding with the circumferential surface of the tool spindle 4. The engagement cylinders are circumferentially arranged about the tool spindle 4 and are secured thereon. The claw sleeve 14 has three entrain webs 15 associated with respective engagement members 12. The weak claw spring 10 is located inside of the rigid ratchet clutch spring 8, with both springs 8 and 10 being located within the support sleeve 3.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A hand-held power screwdriver, comprising a support sleeve (3); a tool spindle (4) axially displaceable in the support sleeve (3); a spindle spring (2) for axially resiliently preloading the tool spindle (4); a low-noise torque clutch (5) for transmitting torque to the tool spindle (4) and formed of combined claw clutch (6) and ratchet clutch (7), the ratchet clutch (7) having a ratchet clutch spring (8) for axially resiliently preloading the ratchet clutch (7), a rotatably driven first ratchet member (7*a*) and a second ratchet member (7*b*), the first and second ratchet members (7*a*, 7*b*) having, respectively, oppositely oriented, circumferentially arranged, oblique cams (9), the claw clutch (6) having a claw spring (10) for axially resiliently preloading the claw clutch (6), a first claw member (6*a*) and a second claw member (6*b*), the first and second claw members (6*a*, 6*b*) having oppositely oriented straight claws (11), respectively, the first claw member (6*a*) of the claw clutch (6) being fixedly connected with the second ratchet member (7*b*) of the ratchet clutch (7) for joint rotation therewith; at least one engagement member (12) for connecting the second claw member (6*b*) with the tool spindle (4) for joint rotation therewith and for disconnecting the claw member (6*b*) from the tool spindle (4); and retaining means for connecting the second claw member (6*b*) of the claw clutch (6) with the tool spindle (4) in a free-running position.

2. A hand-held power screwdriver according to claim 1, wherein a spring rigidity of the ratchet clutch spring (8) is greater than a spring rigidity of the spindle spring (2) a spring rigidity of which is greater than a spring rigidity of the claw clutch spring (10).

3. A hand-held power screwdriver according to claim 1, wherein the second ratchet member (7*b*) and the first claw member (6*a*) are formed by a ratchet sleeve (13) freely rotatable about the tool spindle (4) and axially displaceable therealong, with a rear end side of the ratchet sleeve (13) forming the circumferentially arranged, oblique cams (9) and with a front, drive end side forming the straight claws (11).

4. A hand-held power screwdriver according to claim 1, wherein the second claw member (6*b*) is formed by a rear end side of a claw sleeve (14) axially displaceable over the tool spindle (4), and wherein the at least one engagement member (12) connects the claw sleeve (14) with the tool spindle (4) for joint rotation therewith.

5. A hand-held power screwdriver according to claim 4, wherein the claw sleeve (14) has, at a rear side thereof, at least one, extending radially inwardly, entrain web (15) cooperating with the at least one engagement member (12), and has, at a front, drive side thereof, a free-running region (16) formed as an annular inner groove.

6. A hand-held power screwdriver according to claim 1, wherein the retaining means comprises an annular O-ring (17) securable on the tool spindle (4), the O-ring (17) becoming pinched between the tool spindle (4) and the claw sleeve (14) in the free-running position, frictionally securing the claw sleeve (14) against the resiliently preloaded claw spring (10).

7. A hand-held power screwdriver according to claim 1, wherein the at least one engagement member (12) is secured on the tool spindle (4).

8. A hand-held power screwdriver according to claim 7, wherein at least one engagement member (12) is formed as a cylinder oriented parallel to the tool spindle (4) and arranged radially inside and outside of the tool spindle (4), with a cylinder axis coinciding with a circumferential surface of the tool cylinder (4).

9. A hand-held power screwdriver according to claim 1, comprising three engagement members (12).

* * * * *